US006648733B2

(12) United States Patent
Roberts et al.

(10) Patent No.: US 6,648,733 B2
(45) Date of Patent: Nov. 18, 2003

(54) POLISHING PADS AND METHODS RELATING THERETO

(75) Inventors: John V. H. Roberts, Newark, DE (US); David B. James, Newark, DE (US); Lee Melbourne Cook, Steelville, PA (US); Ronald D. Bakule, Doylestown, PA (US)

(73) Assignee: Rodel Holdings, Inc., Wilmington, DE (US)

( * ) Notice: Subject to any disclaimer, the term of this patent is extended or adjusted under 35 U.S.C. 154(b) by 45 days.

(21) Appl. No.: 09/848,894

(22) Filed: May 4, 2001

(65) Prior Publication Data

US 2002/0077036 A1 Jun. 20, 2002

Related U.S. Application Data

(63) Continuation-in-part of application No. 09/717,470, filed on Nov. 21, 2000, now Pat. No. 6,293,852, which is a continuation of application No. 09/465,566, filed on Dec. 17, 1999, now Pat. No. 6,217,434, which is a continuation of application No. 09/054,948, filed on Apr. 3, 1998, now Pat. No. 6,022,268.

(60) Provisional application No. 60/049,440, filed on Jun. 12, 1997, and provisional application No. 60/043,404, filed on Apr. 4, 1997.

(51) Int. Cl.[7] ..... B24B 1/00

(52) U.S. Cl. ..... 451/41; 451/59; 451/526; 451/533

(58) Field of Search ..... 451/41, 36, 59, 451/63, 285, 287, 526, 530, 533

(56) References Cited

U.S. PATENT DOCUMENTS

| | | | | | |
|---|---|---|---|---|---|
| 2,952,951 | A | * | 9/1960 | Simpson | |
| 3,889,430 | A | | 6/1975 | Scandaletos | |
| 4,927,432 | A | | 5/1990 | Budinger et al. | |
| 5,007,207 | A | | 4/1991 | Phaal | |
| 5,081,051 | A | | 1/1992 | Mattingly et al. | |
| 5,156,843 | A | * | 10/1992 | Leong et al. | 424/411 |
| 5,177,908 | A | | 1/1993 | Tuttle | |
| 5,197,999 | A | | 3/1993 | Thomas | |
| 5,247,765 | A | | 9/1993 | Quintana | |
| 5,394,655 | A | | 3/1995 | Allen et al. | |
| 5,489,233 | A | | 2/1996 | Cook et al. | |
| 5,539,042 | A | * | 7/1996 | Birch | 524/503 |
| 5,569,062 | A | | 10/1996 | Karlsrud | |
| 5,609,517 | A | * | 3/1997 | Lofaro | 451/529 |
| 5,899,745 | A | * | 5/1999 | Kim et al. | 438/692 |
| 5,944,583 | A | * | 8/1999 | Cruz et al. | 451/41 |

* cited by examiner

*Primary Examiner*—Eileen P. Morgan
(74) *Attorney, Agent, or Firm*—Kenneth A. Benson

(57) ABSTRACT

A polishing pad with a polishing layer having a macro-texture and a micro-texture wherein the polishing layer is formed by solidifying a flowable material, the polishing layer further comprising hard domains and soft domains, each domain having an average size less than 100 microns.

24 Claims, No Drawings

POLISHING PADS AND METHODS RELATING THERETO

This application is a continuation-in-part of U.S. application Ser. No. 09/717,470 filed on Nov. 21, 2000 now U.S. Pat. No. 6,293,852. U.S. application Ser. No. 09/717,470 is a continuation of U.S. application Ser. No. 09/465,566 filed on Dec. 17, 1999 (now issued U.S. Pat. No. 6,217,434) which is a continuation of U.S. application Ser. No. 09/054,948 filed on Apr. 3, 1998 (now issued U.S. Pat. No. 6,022,268) which claims the benefit of U.S. Provisional Application Serial No. 60/043,404 filed on Apr. 4, 1997 and U.S. Provisional Application Serial No. 60/049,440 filed on Jun. 12, 1997.

The present invention relates to polishing pads useful in the manufacture of semiconductor devices by chemical mechanical polishing of semiconductor substrates such as silicon dioxide, silicon, metal, dielectric materials (including polymeric dielectric materials). The polishing pad of this invention has a polishing layer comprising hard domains and soft domains.

U.S. Pat. No. 5,197,999 describes a polishing pad with a soft matrix material and discrete particles distributed substantially uniformly throughout the matrix to effect stiffening of the polishing pad.

Chemical mechanical polishing (CMP) is an enabling technology for the production of complex and dense semiconductor structures on semiconductor substrates and is an effective method for the removal and planarization of thin films on semiconductor substrates during the production of integrated circuits including multi-chip modules, capacitors and the like. Semiconductor device fabrication generally requires CMP of one or more substrates, such as silicon, silicon dioxide, tungsten, copper or aluminum. Due to fine feature geometries of semiconductor devices, semiconductor substrates must be precision polished by CMP to narrow tolerances.

In known CMP, the semiconductor substrate to be polished is mounted on a carrier or polishing head of a polishing machine. The exposed surface of the substrate is placed against a rotating polishing pad. Typically, polishing pads used in CMP comprise a polymeric layer that contacts the semiconductor substrate being polished and is referred to herein as the polishing layer. The polishing pad may be a standard pad (without any abrasive particles in the polishing layer), also referred to herein as a non fixed-abrasive pad, or a fixed-abrasive pad (containing abrasive particles in the polishing layer). The carrier head provides a controllable pressure (or downforce), on the substrate to bias it towards the polishing layer of the polishing pad. A polishing fluid with or without abrasive particles is then dispensed at the interface of the substrate and the polishing layer of the polishing pad to enhance removal of the target layer (for e.g., metal layer in first-step CMP or barrier layer in second-step CMP) on the substrate. The polishing fluid is preferably water based and may or may not require the presence of abrasive particles, depending on the composition of the polishing layer of the polishing pad. An abrasive-free polishing fluid also referred to as a reactive liquid is typically used with a fixed-abrasive pad. A polishing fluid containing abrasive particles, also referred to herein as slurry, is typically used with a non fixed-abrasive pad.

In the context of this invention the term "polymer" includes: various types of copolymers such as random copolymers, branched copolymers, block copolymers, multi-block copolymers, graft copolymers, and alternating copolymers; homopolymer blends; homopolymer and copolymer blends; and polymer blends including interpenetrating polymer networks.

The polishing layer of the present invention is formed by any one of the processes of extruding, embossing, molding, printing, casting, sintering, photo-imaging, chemical etching, solidifying, skiving, or any similar-type processes.

In an embodiment, the polishing layer of the polishing pad comprises one or more materials having: i. a density greater than 0.5 g/cm$^3$; ii. a critical surface tension greater than or equal to 19, 20, 21, 22, 23, 24, 25, 26, 27, 28, 29, 30, 31, 32, 33, 34, 35, 36, 37, 38, 39, 40, 41, 42, 43, 44, 45 milliNewtons per meter; iii. a tensile modulus of 0.02 to 5 GigaPascals; iv. a ratio of tensile modulus at 30° C. to tensile modulus at 60° C. of 1.0 to 2.5; v. a hardness of 25 to 80 Shore D; vi. a yield stress of 300–6000 psi (2.1–41.4 MegaPascal); vii. a tensile strength of 1000 to 15,000 psi (7–105 MegaPascal); and viii. an elongation to break up to 500%. In an embodiment, the polishing material is an engineering thermoplastic elastomer.

In a preferred embodiment, the polishing layer of the polishing pad comprises one or more polymeric materials having a plurality of hard domains and soft domains, the hard domains and soft domains enabling enhanced interaction between the substrate surface and the polishing pad surface during CMP. In an alternate embodiment, the polymeric material of the polishing layer of the polishing pad comprises a phase-separated polymer, the phase-separated polymer providing hard domains and soft domains in the polishing layer. The hard domain size (height, width or length) is less than 100 microns, more preferably less than 50 microns, yet more preferably less than 25 microns and most preferably less than 10 microns. The soft domain size is less than 100 microns, more preferably less than 50 microns, yet more preferably less than 25 microns and most preferably less than 10 microns.

In an embodiment, the polishing layer of the polishing pad comprises one or more polymeric materials, wherein hard domains and soft domains in the polishing layer are created: 1. by incorporating hard and soft segments along a polymer backbone; or 2. by crystalline regions and non-crystalline regions within the polymeric materials; or 3. by alloying a hard polymer with a soft polymer; or 4. by combining one or more polymers with an organic filler or an inorganic filler.

In an embodiment, the hard domains in the polishing layer are provided by hard organic fillers dispersed in the polishing layer. In an alternate embodiment, the hard domains are provided by hard organic fillers while the soft domains are provided by soft organic fillers. By "hard" is meant a material that is relatively harder than the surrounding polymeric material of the polishing layer of the polishing pad. By "soft" is meant a material that is relatively softer than the surrounding polymeric material of the polishing layer of the polishing pad. The hard domains of the polishing layer are more resistant to plastic flow and tend to cause the micro-protrusions on the polishing pad surface to rigorously engage the surface of the substrate during CMP, whereas the soft domains are less resistant to plastic flow during polishing and tend to enhance polishing interaction between the micro-protrusions on the polishing pad surface and the substrate surface being polished.

In an embodiment, the polishing layer of the polishing pad has an ability to absorb and transport slurry particles due to the presence of pores in the polishing layer.

Polymers or mixtures of polymers suitable for use as the polymeric material in the polishing layer of the polishing pad of this invention exhibit the following properties: a density of greater than 0.5 g/cm$^3$, more preferably greater than 0.7 g/cm$^3$ and yet more preferably greater than about 0.9 g/cm$^3$; a critical surface tension greater than or equal to 19, 20, 21, 22, 23, 24, 25, 26, 27, 28, 29, 30, 31, 32, 33, 34, 35, 36, 37, 38, 39, 40, 41, 42, 43, 44, 45 milliNewtons per meter; a tensile modulus of 0.02 to 5 GigaPascals; a ratio of the tensile modulus at 30° C. to the modulus at 60° C. in a range of 1.0 to 2.5; hardness of 25 to 80 Shore D; a yield stress of 300 to 6000 psi; a tensile strength of 500 to 15,000 psi, and an elongation to break up to 500%.

Exemplary polymers for use in the polishing pad of this invention include polycarbonates, polysulfones, nylons, ethylene copolymers, polyethers, polyesters, polyether-polyester copolymers, acrylic polymers, polymethyl methacrylate, polyvinyl chloride, polycarbonate, polyethylene copolymers, polyethyleneimines, polyurethanes, polyethersulfones, polyetherimides, polyketones, and the like, including photochemical reactive derivatives thereof.

In an embodiment, the polishing layer comprises engineering thermoplastic elastomers including thermoplastic block copolymers such as styrene-butadiene copolymers.

In an embodiment, the polymeric material comprising the polishing layer of the polishing pad is sufficiently hydrophilic to provide a critical surface tension greater than or equal to 19, 20, 21, 22, 23, 24, 25, 26, 27, 28, 29, 30, 31, 32, 33, 34, 35, 36, 37, 38, 39, 40, 41, 42, 43, 44, 45 milliNewtons per meter, and in some applications of the present invention greater than or equal to 37 and yet more preferably greater than or equal to 40 milliNewtons per meter. Critical surface tension defines the wettability of a solid surface by noting the lowest surface tension a liquid can have and still exhibit a contact angle greater than zero degrees on that solid. Thus, polymers with higher critical surface tensions are more readily wet and are therefore more hydrophilic. In an embodiment, the use of relatively more hydrophilic polymers in the polishing layer of the polishing pad enables better interaction between the polishing pad and the substrate surface during the CMP process. Critical Surface Tension of common polymers are as follows:

| Polymer | Critical Surface Tension (mN/m) |
|---|---|
| Polytetrafluoroethylene | 19 |
| Polydimethylsiloxane | 24 |
| Silicone Rubber | 24 |
| Polybutadiene | 31 |
| Polyethylene | 31 |
| Polystyrene | 33 |
| Polypropylene | 34 |
| Polyester | 39–42 |
| Polyacrylamide | 35–40 |
| Polyvinyl alcohol | 37 |
| Polymethyl methacrylate | 39 |
| Polyvinyl chloride | 39 |
| Polysulfone | 41 |
| Nylon 6 | 42 |
| Polyurethane | 45 |
| Polycarbonate | 45 |

In an embodiment, the polishing layer of the polishing pad is derived from one or more of the following:

1. an acrylated urethane;
2. an acrylated epoxy;
3. an ethylenically unsaturated organic compound having a carboxyl, benzyl, or amide functionality;
4. an aminoplast derivative having a pendant unsaturated carbonyl group;
5. an isocyanurate derivative having at least one pendant acrylate group;
6. a vinyl ether,
7. a urethane
8. a polyacrylamide
9. an ethylene/ester copolymer or an acid derivative thereof;
10. a polyvinyl alcohol;
11. a polymethyl methacrylate;
12. a polysulfone;
13. a polyamide
14. a polystryene;
15. a polybutadiene;
16. a polycarbonate;
17. a polyvinyl chloride;
18. an epoxy;
19. a copolymer of the above; or
20. a combination thereof.

In an embodiment, hard domains and soft domains are produced during the formation of the polishing layer of the polishing pad by phase separation, due to incompatibility between the hard and soft polymer segments on the backbone of the polymer molecule. Exemplary polymers having hard segments and soft segments include ethylene copolymers, copolyesters, block copolymers, polysulfone copolymers and acrylic copolymers.

In an embodiment, inorganic fillers are utilized to form hard domains in the polishing layer. Exemplary inorganic fillers include, but are not limited to, alumina, ceria, diamond, silica, titania, zirconia, germania, boron nitride, boron carbide, silicon carbide or mixtures thereof, either alone or interspersed in a friable matrix which is separate from the continuous phase of the pad material.

In an embodiment, organic fillers are utilized to form hard domains and soft domains. Exemplary organic fillers for use in the polishing pad include porogens (polymeric particles). In an embodiment, hard porogens are utilized to form hard domains and soft porogens are utilized to form soft domains in the polishing layer. By "hard" is meant a material that is relatively harder than the surrounding polymeric material of the polishing layer. By "soft" is meant a material that is relatively softer than the surrounding polymeric material of the polishing layer. In this embodiment, the porogens are not compatible with the polymeric matrix of the polishing layer so that phase separation of the porogens occurs in the respective hard domains and soft domains in the polishing layer. The porogens have particle sizes preferably from about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, to about 50 microns.

In an embodiment, porogens are utilized to form a porous polishing layer that has an intrinsic ability to transport slurry particles. In this embodiment, the polishing layer comprises a polymeric matrix derived from polymers that are resistant to thermal degradation relative to the porogens, i.e., the polymers comprising the polymeric matrix do not degrade under the same conditions as the porogens.

The formation of a porous polishing layer utilizing porogens comprises the steps of: 1) creating a polymeric layer with one or more polymers and incorporating porogens into the polymeric layer wherein the polymers are more resistant to degradation relative to the porogens and ensuring that the porogens are substantially uniformly dispersed in the polymeric layer; 2) curing the polymeric layer without substantially removing the porogens; and 3) curing the polymeric layer to remove the porogens without adversely affecting the surrounding polymeric matrix to form a porous polishing layer.

Typical methods for removal of porogens from the polymeric layer include exposure to heat, pressure or radiation. Radiation sources include infrared, microwave, ultraviolet, x-ray, gamma-ray, alpha particles, neutron beam or electron beam sources. The porogens are removed from the polymeric layer under a flow of inert gas to form a porous polishing layer. The energy flux of the radiation must be sufficiently high such that the porogens are removed.

In an embodiment, a porous polishing layer is generated by thermally removing the porogens incorporated into the polymeric layer under vacuum or in a nitrogen, argon, mixtures of nitrogen and hydrogen, such as forming gas, or other inert or reducing atmosphere. The porogens of the present invention may be removed at any temperature that is higher than the thermal curing temperature and lower than the thermal decomposition temperature of the polymeric matrix of the polishing layer. Typically, the porogens for use in the polishing pad of this invention are removable at temperatures in a range of about 150° C. to about 450° C., preferably in a range of about 250° C. to about 425° C. Typically, the porogens are removed by heating for a period of time in a range of about 1 to 120 minutes. Exemplary heating techniques for use in this invention include conventional heating in an oven or microwave heating. A combination of heat and electromagnetic radiation is also used to remove the porogens.

Exemplary polymers resistant to thermal degradation include polyetherimides, polyethersulfones, polyphenylene sulfide, polyetheretherketone, polyketones, polyamide imides and other members of the three families: sulfone-based polymers, imide-based polymers, and polyarylates. Combinations of the above listed polymers may also be used with additives (for e.g. glass fibers) to increase their resistance to degradation at high temperatures.

Polymers suitable for use as porogens in the present invention are derived from ethylenically or acetylenically unsaturated monomers and are removable, such as by the unzipping of the polymer chains to the original monomer units which are volatile and diffuse readily through the polishing layer. By "removable" is meant that the porogens depolymerize, degrade or otherwise break down into volatile components which can then diffuse through the polishing layer material. The porogens are removed by exposure to radiation in an inert atmosphere such as nitrogen. Exemplary radiation sources include visible light and ultraviolet light. A combination of heat and radiation is also used to provide the appropriate energy flux of radiation to remove the porogens. Suitable unsaturated monomers include, but are not limited to: methacrylic acid, methacrylamides, alkyl methacrylates, alkenyl methacrylates, aromatic methacrylates, vinyl aromatic monomers, nitrogen-containing compounds and their thio-analogs, and substituted ethylene monomers.

Porogens for use in the polishing pad of this invention include cross-linked polymer chains. Any amount of cross-linker is suitable for use in the present invention. Typically, the porogen contains at least 1% by weight of cross linker, based on the weight of the porogen. As the amount of cross linker in the porogen increases, the conditions for removal of the porogen from the polymeric matrix of the polishing layer correspondingly changes. Further details on porogens are found in U.S. application Ser. No. 09/460,326 filed on Dec. 10, 1999 and is herein incorporated by reference for all useful purposes.

Suitable polymers useful as porogens include: HEMA/DEGDMA, MMA/DEGDMA, MMA/MAPS/DEGDMA, MMA/MAPS/PETTA, MMA/MAPS/PPG4000DMA, MMA/MAPS/DPEPA, MAPS/DEGDMA, BA/DEGDMA, MMA/MAPS/TMPTMA, MMA/MAPS/DVB, STY/MAPS/DVB, BA/MAPS/DVB, BA/TMSMA/DVB, BA/MOPTSOMS/DVB, BA/MOPMDMOS/DVB, BA/MAPS/TAT, ALMA/BA/DVB, IBMA/MAPS/DVB, IBOMA/MAPS/DVB, BA/DVB, BA/PGDMA, BA/ALMA, BA/TMPTMA, BA/DPEPA, EHA/DVB, EHA/ALMA, EHA/TMPTMA, EHA/DPEPA, STY/DVB, STY/ALMA, EHA/STY/ALMA, MMA/BA/ALMA, STY/MMA/DVB, MMA/butadiene/STY, MMA/EA/ALMA, BA/ALMA/MATS, STY/MATS/DVB, MMA/BA/MATS, STY/MMA/MATS/DVB, MMA/BA/MATS/ALMA, BzA/TMPTMA, BzA/DVB, IDMA/BzMA and MMA/ALMA/MATS.

The various abbreviations have the following meanings: ALMA=Allyl methacrylate; BA=butyl acrylate; BzA=benzylacrylate; BzMA=benzyl methacrylate; DEGDMA=diethyleneglycol dimethacrylate; DVB=divinylbenzene; DPEPA=dipentaerythriol pentaacrylate; EA=EHA=2-ethylhexyl acrylate; HEMA=1-methyl-2-hydroxyethyl methacrylate; MMA=methyl methacrylic acid; IDMA=isodecyl methacrylate; IBMA=isobutyl methacrylate; IBOMA=isobomyl methacrylate; MAPS=MATS=(trimethoxylsilyl)propylmethacrylate; MOPMDMOS=3-methacryloxypropylmethyldimethoxysilane; MOPTSOMS=methacryloxy propylbis(trimethylsiloxy) methylsilane; TMSMA=trimethylsilyl methacrylate; TMPTMA=trimethylolpropane trimethylacrylate; PETTA=pentaerythriol tetra/triacetate; PGDMA=propyleneglycol dimethacrylate; PPG4000DMA=polypropyleneglycol4000 dimethacrylate;STY=styrene.

In an embodiment, the polishing layer of the polishing pad is made by any one of the following processes: 1. thermoplastic injection molding, 2. thermoset injection molding (often referred to as "reaction injection molding" or "RIM"), 3. thermoplastic or thermoset injection blow molding, 4. compression molding, 5. sintering, or 6. any similar-type process in which a flowable material is positioned and solidified. In a preferred molding embodiment of the present invention: 1. the flowable material is forced into or onto a structure or substrate, 2. the structure or substrate is thereafter separated from the solidified material.

RIM generally involves mixing reactive liquid (or semi-liquid) precursors which are then rapidly injected into the mold. Once the mold is filled, the reactive precursors react chemically, causing solidification of the reaction products to form a final molded product. The final molded product in the context of this invention being a polishing pad. RIM is preferred, because the physical properties of the polishing pad can be adjusted by selecting appropriate reactive precursors. In addition, RIM generally utilizes lower viscosity precursors than thermoplastic injection molding, thereby allowing for easier filling of high aspect ratio molds utilized during the molding process.

Urethane prepolymers are a preferred reactive chemistry for reaction injection molding to form the polishing layer of the polishing pad of this invention. "Prepolymers" are intended to mean any precursor to the final polymerized product, including oligomers and monomers. Many such prepolymers are well known and commercially available. Urethane prepolymers generally comprise reactive moieties at the ends of the prepolymer chains.

The polishing pad is generally made by RIM of an isocyanate prepolymer with a second prepolymer having an isocyanate reactive moiety. Commercially available isocyanate prepolymers include di-isocyanate prepolymers and tri-isocyanate prepolymers. Examples of di-isocyanate polymers include toluene diisocyanate and methylene diisocyanate. Preferably, the isocyanate prepolymer comprises an average isocyanate functionality of at least two (i.e., at least two isocyanate reactive moieties in the prepolymer molecule). An average isocyanate functionality greater than 4 is generally not preferred, since processing of the resulting polymerized product can become difficult, depending upon the molding equipment and process used.

Isocyanate reactive moieties include amines, particularly primary and secondary amines, and polyols. Thus, prepolymers containing isocyanate reactive moieties include diamines, diols and hydroxy functionalized amines.

When the molding operation is performed, a catalyst is often necessary to decrease the polymerization reaction time, particularly the gel time and the de-mold time. However, if the reaction is too fast, the material may solidify or gel prior to complete filling of the mold. Gel time is in a range of about half second to one hour, preferably in a range of about 1 second to about 5 minutes, more preferably in a range of about 10 seconds to about 5 minutes, and yet more preferably in a range of about 30 seconds to about 5 minutes.

Exemplary catalysts for use in this invention are devoid of transition metals, particularly zinc, copper, nickel, cobalt, tungsten, chromium, manganese, iron, tin, or lead. A preferred catalyst for use with a urethane prepolymer system comprises a tertiary amine, such as, diazo-bicyclo-octane. Other useful catalysts include, organic acids, primary amines and secondary amines, depending upon the particular reactive chemistry chosen.

In embodiments involving molding, the polishing pad is also formed by injecting a flowable material into a mold at a point along the periphery of the mold, i.e., side-filled. The polishing pad is also formed by injecting a flowable material into a mold at or near the geometric center of a face of the mold. In an embodiment, a solid or semi-solid insert is placed in an enclosure and the flowable material is then forced into the enclosure, thereby causing the insert to be bonded to or within the material after it has solidified. The insert can provide reinforcement to the polishing pad so that the solidified material around the insert need not be self-supporting or otherwise of a consistency necessary to support the polishing layer. In an alternate embodiment, the insert can provide structural integrity to the polishing pad, thereby providing improved polishing pad performance and longer life during CMP.

In an embodiment, the polishing layer of the polishing pad further comprises a macro-texture and a micro-texture. The macro-texture further comprises macro-indentations, channels or grooves and the micro-texture further comprises micro-indentations and micro-protrusions. The macro-texture and micro-texture on the surface of the polishing layer in combination provide improved flow and distribution of polishing fluid across the polishing pad surface during CMP leading to more uniform interaction between the surface of the substrate being polished and the polishing pad surface resulting in relatively more consistent performance of the polishing pad of this invention when compared with prior art polishing pads.

A method for creating macro-channels or macro-indentations in the polishing layer is by molding, for example injection molding, whereby the macro-texture is formed in situ by one or more thin-walled protrusions extending into the mold. The mold protrusions preferably provide an inverted image which is complementary to the intended macro-texture design or configuration.

In an embodiment, a portion of the micro-indentations or micro-protrusions is created during the molding process by incorporation of appropriate features into the mold. Formation of micro-texture and macro-texture during molding of the polishing pad can diminish or even remove the necessity for break-in of the polishing pad prior to use. This method allows for more controlled replication of micro-texture on the polishing pad surface as compared to modification of the polishing pad surface subsequent to creation of the polishing pad by a process step such as conditioning.

An agent comprising a wax, hydrocarbon or other solid, semi-solid or liquid organic material can be applied to the mold to enhance release of the molded part after molding. An exemplary release agent comprises a solid organic material and a solvent or liquid carrier. A preferred mold release agent is a fluorocarbon dispersion, available from E. I. du Pont de Nemours and Company, Wilmington, Del., USA. Preferred solvents or liquid carrier materials have a vapor pressure in the range of 0.1 to 14.7 pounds per square inch ("psi"), more preferably 1–12 psi and yet more preferably in the range of 4.5 to 5.5 psi. In an embodiment, a wax, hydrocarbon or other non-polar solid organic material is dissolved or suspended in an organic solvent, preferably a non-polar organic solvent, such as mineral spirits, and applied as a mold release agent prior to the injection operation. Alternatively, an internal mold release agent can be used, which is incorporated directly into the polishing pad material and aids in de-molding the polishing pad during polishing pad manufacture by molding.

For embodiments of the present invention which involve molding, the average mold aspect ratio is at least 400, more preferably at least 500, and yet more preferably at least 700. The "aspect ratio" is intended to mean a selected length divided by the average thickness of the polishing pad. Polymers used to make the polishing pad can be molded utilizing high aspect ratio molds, contrary to prevailing views in industry. Thus, the polishing pad is generally more precise and reproducible relative to conventional polishing pads.

After forming the polishing layer, a micro-texture can be imparted to the surface of the polishing layer by moving the polishing pad surface against a surface containing an abrasive material (rigid particles). In an embodiment, the abrasive material is a rotating structure (the abrasive material can be round, square, rectangular, oblong or of any geometric configuration) having a plurality of rigid particles embedded (and preferably, permanently affixed) upon the surface. The movement of the abrasive surface against the polishing pad surface causes the polishing pad surface to undergo plastic flow, fragmentation or a combination thereof (at the point of contact with the particles). The abrasive surface can move against the polishing pad in any one of a number of ways, including vibration, rotation, linear movement, random orbitals, rolling or the like. The resulting plastic flow, fragmentation or combination thereof (due to the abrasive surface), creates a micro-texture upon the polishing pad surface.

In an embodiment, micro-texture comprising micro-protrusions and micro-indentations, covers at least 0.1 percent of the surface area of the polishing pad surface. The micro-indentations have an average depth of less than 50 microns, yet more preferably less than 10 microns, and the micro-protrusions have an average height of less than 50 microns, yet more preferably less than 10 microns. Surface modification by conditioning causes minimal abrasion removal of the polishing layer but is sufficient to generate a micro-texture on the polishing pad surface.

Abrasive particles are also incorporated into the polishing layer of the polishing pad of this invention. De-watered slurry or any precursor to a polishing fluid may be incorporated into the polishing layer of the polishing pad of this invention, whereby during CMP, as polishing fluid is provided at an interface between the polishing layer of the polishing pad of this invention and the semiconductor substrate, the constituents of the polishing layer improve the polishing fluid to enhance the polishing performance of the polishing pad of this invention.

The polishing pad of the present invention is used in combination with a polishing fluid, such as a polishing slurry, for CMP of a metal, silicon or silicon dioxide substrate. During polishing, the polishing fluid is placed between the polishing pad surface and the substrate surface to be polished. As the pad is moved relative to the substrate being polished, the micro-indentations allow for improved polishing fluid flow along the interface (between the pad and the substrate to be polished). The improved flow of polishing fluid generally allows for more efficient and effective polishing performance of the polishing pad. Also, during polishing, the substrate surface and the polishing pad surface are pressed against each other at a pressure greater than 0.1 kilograms per square meter. Surface irregularities on the substrate surface are removed at a rate which is dependent upon a number of parameters, including: pressure (downforce) on the substrate surface; the speed at which the polishing pad and the substrate move relative to one another; and the components of the polishing fluid.

The micro-texture on the polishing pad surface can experience abrasion removal or plastic flow (i.e., the surface micro-protrusions are flattened or are otherwise less pronounced), which can diminish polishing performance of the polishing pad. Conditioning is typically employed during CMP to regenerate and augment the micro-texture on the polishing pad surface. Conditioning is performed by moving an abrasive-containing surface on the polishing pad surface in the presence of deionized water, an abrasive-containing conditioning fluid or an abrasive-free conditioning fluid. An exemplary surface containing abrasives utilized for conditioning the surface of a polishing pad is a disk made of metal embedded with diamonds of a size in a range of 1 micron to about 0.5 millimeters such as a four-inch diameter, 100 grit diamond disk. During conditioning, the pressure between the conditioning disk and the polishing pad surface is preferably between 0.1 to about 25 pounds per square inch. The speed of rotation of the conditioning disk is in a range of about 1 to about 1000 revolutions per minute.

The following claims define this invention and should be accorded the broadest possible interpretation to encompass all modifications obvious to one skilled in the art.

What is claimed is:

1. A polishing pad comprising:

a polishing layer with a polishing surface; said polishing layer comprising a material having a plurality of hard domains and soft domains wherein said hard domains have an average size less than 100 microns and said soft domains have an average size less than 100 microns; and wherein the polishing surface further has a macro-texture produced by solidifying a flowable material.

2. A polishing pad in accordance with claim 1 wherein the polishing layer has no intrinsic ability to absorb slurry particles or to transport slurry particles.

3. A polishing pad in accordance with claim 1 wherein the polishing layer is porous and has an intrinsic ability to absorb slurry particles and transport slurry particles.

4. A polishing pad in accordance with claim 1 wherein the polishing layer is hydrophilic.

5. A polishing pad in accordance with claim 1 wherein the hard domains and the soft domains are produced by phase separation as the polishing layer is fanned.

6. A polishing pad in accordance with claim 5 wherein the phase-separated polymer is a copolymer selected from a group consisting of random, branched, block, alternating and graft copolymers.

7. A polishing pad in accordance with claim 6 wherein the polishing layer comprises a block copolymer having hard segments and soft segments.

8. A polishing pad in accordance with claim 7 wherein the block copolymer is a styrene-butadiene copolymer.

9. A polishing pad in accordance with claim 1 wherein the polishing layer comprises porogens incorporated into a polymeric matrix, with said hard domains comprising hard porogens and said soft domains comprising soft porogens.

10. A polishing pad in accordance with claim 1 wherein the polishing layer consists essentially of a material selected from the group consisting of: polymethyl inethacrylate, polyvinyl chloride, polysulfone, nylon, polycarbonate, polyurethane, ethylene copolymer, polycthersulfonc, polyether imide olyothyleneimine, polyketone, and combinations thereof.

11. A polishing pad in accordance with claim 1 wherein the polishing layer is formed in a mold.

12. A polishing pad in accordance with claim 11 wherein said mold has a surface texture for imparting a micro-texture upon the polishing surface during formation of the polishing layer in the mold.

13. A polishing pad in accordance with claim 11 wherein said mold has a surface texture for imparting a macro-texture to the polishing layer during formation of the polishing layer in the mold.

14. A polishing pad in accordance with claim 1 wherein the polishing layer is formed in a mold by a sintering process.

15. A method for planarizing a silicon, silicon dioxide or metal substrate, comprising:

i) providing a polishing pad comprising a polishing layer with a polishing surface;

ii) using a pressure greater than 0.1 kilograms per square meter between the substrate and said polishing surface of said polishing pad; wherein the polishing pad has a polishing layer with a polishing surface; said polishing layer comprising a material having a plurality of hard domains and soft domains wherein said hard domains have an average size less than 100 microns and said soft domains have an average size less than 100 microns; and wherein the polishing surface further has a macro-texture produced by solidifying a flowable material.

16. A method in accordance with claim 15 wherein the method is performed utilizing the polishing pad wherein the hard domains and the soft domains are produced by phase separation as the polishing layer is formed and the phase-separated polymer is a copolymer selected from a group consisting of random, branched, block, alternating and graft copolymers.

17. A method in accordance with claim 15 wherein the method is performed utilizing the polishing pad wherein the polishing layer comprises a block copolymer having hard segments and soft segments and the block copolymer is a styrene-butadiene copolymer.

18. A method in accordance with claim 15 wherein the method is performed utilizing the polishing pad wherein the polishing layer consists essentially of a material selected from the group consisting of: polymethyl methacrylate, polyvinyl chloride, polysulfone, nylon, polycarbonate, polyurethane, thylene copolymer, polyethersulfone, polyether imide, polyethyleneimine, polyketone, and combinations thereof.

19. A method in accordance with claim 15 further comprising: periodically renewing the micro-texture or micro-asperities during polishing of the substrate by moving an abrasive medium against and relative to the polishing surface of said polishing pad, said abrasive medium carrying a plurality of abrasive particles.

20. A method in accordance with claim 15 wherein the method is performed on a substrate containing a metal selected from the group consisting of copper, tungsten, and aluminum.

21. A method in accordance with claim 16 wherein the method step is performed on a substrate containing a metal selected from the group consisting of copper, tungsten and aluminum.

22. A method in accordance with claim 17 wherein the method step is performed on a substrate containing a metal selected from the group consisting of copper, tungsten and aluminum.

23. A method in accordance with claim 18 wherein the method step is performed on a substrate containing a metal selected from the group consisting of copper, tungsten acid aluminum.

24. A method in accordance with claim 15 wherein the method step is performed on a substrate containing a metal selected from the group consisting of copper, tungsten and aluminum.

* * * * *